United States Patent [19]

Quellais

[11] Patent Number: 5,048,777

[45] Date of Patent: Sep. 17, 1991

[54] RETRACTABLE SUPPORT STAND

[75] Inventor: Jacques Quellais, Saint Jorioz, France

[73] Assignee: Salomon S.A., Annecy Cedex, France

[21] Appl. No.: 471,921

[22] Filed: Jan. 29, 1990

[30] Foreign Application Priority Data

Jan. 31, 1989 [FR] France ..... 89 01185

[51] Int. Cl.[5] ..... A63B 55/00

[52] U.S. Cl. ..... 248/96; 206/315.7; 248/176

[58] Field of Search ..... 248/96, 97, 188.6, 176, 248/170, 168, 167; 206/315.7, 315.3

[56] References Cited

U.S. PATENT DOCUMENTS

| | | | |
|---|---|---|---|
| 1,887,838 | 11/1932 | Gunther . | |
| 2,016,967 | 10/1935 | Komers | 248/96 |
| 2,199,055 | 4/1940 | Staugaitis | 248/96 |
| 2,571,088 | 10/1951 | Walton | 248/96 |
| 2,749,069 | 6/1956 | Sandstrom . | |
| 4,054,256 | 10/1977 | Buck, Jr. et al. | 248/96 |
| 4,087,068 | 5/1978 | Gardner | 248/96 |
| 4,226,389 | 10/1980 | Neth | 248/96 |
| 4,778,136 | 10/1988 | Reimers | 248/96 |
| 4,798,357 | 1/1989 | Cho | 248/96 |
| 4,898,352 | 2/1990 | Hoffman | 248/96 |

*Primary Examiner*—Ramon O. Ramirez

*Attorney, Agent, or Firm*—Sandler, Greenblum & Bernstein

[57] ABSTRACT

A retractable support stand, preferably for a golf bag. The support stand includes two support members mounted about respective journal axes for movement between a collapsed position and a deployed position, wherein the two support members extend divergently from the bag base with respect to each other in the deployed position, and are adapted to extend less divergently in the collapsed position. A mechanism is provided to selectively bias the two support members toward either of the collapsed position and the deployed position.

27 Claims, 4 Drawing Sheets

RETRACTABLE SUPPORT STAND

BACKGROUND OF THE INVENTION

1. Field of the Invention

The present invention relates to a retractable rod stand, preferably for a golf bag, as well as to a golf bag equipped with such a stand.

2. Description of Background and Relevant Information

Golf bags for containing and arranging the various clubs which are used during the practice of golf are often provided, at their upper ends, with a foldable support comprising two retractable journalled rods which are normally pressed against the top of the bag, when the bag is being transported, but which can be deployed to diverge with respect to one another in a manner so as to form a V support on the ground. As a result, when the support of the bag is deployed, i.e., when it is unfolded, the bag can be placed in an inclined position on the ground on which it rests at three points, namely, a rear support point for the bottom of the bag and two front support points corresponding to the ends of the two deployed rods of the support. As a result, the opening of the bag through which the heads of the different clubs extend, is spaced from the ground and one thus prevents the golf club heads coming into contact with the ground and becoming dirty.

Amongst the various retractable rod stands for golf bags which are presently known, those described in U.S. Pat. Nos. 1,887,838 and 2,749,089 each comprise two rods which are separately journalled, around individual axes, on a base which is affixed to the periphery or rim of the bag surrounding the upper opening thereof. The two journal axes of the two rods are contained in a single transverse plane with respect to the bag and they converge at a point positioned on the exterior of the bag. As a result, during deployment of the two rods, they form a V, the spacing of the two rods increasing as a function of the deployment location of the rods. The two rods are biased towards a rest or returned position along the bag, by respective return springs which cause the automatic return of the rods to the rest position along the bag as soon as one frees the rods, such as for example by lifting the bag.

The retractable rod supports for known golf bags, of the individual spring type for the automatic return of the rods to the retracted position along the bag, have in the first place the disadvantage that if, as a result of any movement of the bag, the contact of the lower ends of the rods with the ground ceases, the rods are automatically returned against the bag and, consequently, the support that the two rods provide cannot maintain the fixed position on their own. Furthermore, the journal axes of the two rods are independent of one another and the simultaneous deployment of these two rods requires providing a relatively complex mechanism which establishes a linkage between the two rods at points situated at a distance from their journal axes.

SUMMARY OF THE INVENTION

It is an object of the present invention to overcome the disadvantages noted above by providing a support stand for an object including:

a base adapted to be affixed to the object;

two support members mounted about respective journal axes with respect to the base for movement between a collapsed position and a deployed position, wherein the two support members extend divergently from the base with respect to each other in the deployed position, and are adapted to extend less divergently in the collapsed position; and means for selectively biasing the two support members toward either of the collapsed position and the deployed position. According to one aspect of the invention, the base is unitary with the object.

According to a specific embodiment of the invention, the two support members are connected by means of a linkage member, and the linkage member constitutes means for moving one of the support members (1) from the collapsed position to the deployed position by movement of the other of the support members from the collapsed position to the deployed position and (2) from the deployed position to the collapsed position by movement of the other of the support members from the deployed position to the collapsed position.

According to another specific feature of the invention, the two support members are each connected to the linkage member by a coupling element, the coupling elements being of the cardan type.

It is a further object of the present invention to provide a support stand for a golf bag including:

a base adapted to be affixed to a golf bag, the base having an abutment surface;

at least one support member connected to the base for movement between a rest position and a support position, wherein in the support position, the support member is adapted to extend outwardly from the golf bag to support the golf bag; and means for selectively biasing the support member toward either of the rest position and the support position, wherein in the support position, the biasing means biases a portion of the support member against the abutment surface of the base.

More specifically according to the invention, the support member is mounted to the base at a journal axis, the biasing means includes a spring being connected to a the base at an attachment point and being connected to the support member at a traction point, wherein in the rest position, the traction point is positioned on one side of a plane passing through the journal axis and the attachment point and, in the support position, the traction point is positioned on an opposite side of the plane passing through the journal axis and the attachment point.

Further according to the invention, the at least one support member includes two of the support members, wherein the two support members are each connected to a linkage member by means proximate the plane passing through the journal axis and the attachment point.

According to a specific embodiment of the invention, the two support members are each connected to a linkage member by a coupling element, wherein each of the coupling elements have a generally cylindrical shape and have diametrically opposed cut-outs, which are variable in width, the linkage member having opposed ends, each of the ends having spaced tips, the spaced tips of the respective ends of the linkage member being received within the opposed cut-outs of a respective one of the coupling elements, the variable width of the cut-outs of the coupling elements enabling a required clearance for the tips during rotation of the linkage member.

It is another feature of the invention that the support members are rods which are adapted to extend divergently from the base with respect to each other in the support position, and are adapted to extend less divergently in the rest position.

In a further specific embodiment, the support members are adapted to converge toward each other from the base in the rest position.

It is a still further object of the invention to provide a retractable support stand for a golf bag including:

a base adapted to be affixed to a golf bag;

two rods journalled on the base around predetermined rotational axes for movement between a rest position and a deployed position; and means for elastically biasing each of the two rods toward either of the rest position and the deployed position;

wherein the biasing means include a traction spring provided for each of the rods, a first end of each the spring being affixed relative to the base at an attachment point, and a second end of each spring being affixed relative to a respective one of the rods at a traction point, the attachment points and the traction points being positioned, with respect to one another, in a manner such that during pivoting of either of the rods from a respective rest position, at which the rod is adapted to be positioned adjacent the bag, to a respective deployed position, at which the rod is adapted to project from the bag, or during pivoting of the rod from the deployed position to the rest position, a respective traction point passes from one side to the other of a plane passing through a respective attachment point and a respective rotational axis of the rod.

According to one feature of the invention, a linkage bar is provided connecting the two rods, the linkage bar being positioned adjacent the aforementioned plane.

According to another feature of the invention, a cardan type assembly is provided connecting respective ends of the linkage bar and respective ones of the two rods proximate the rotational axes of the two rods.

According to a further aspect of the invention, in the deployed position, each of the rods is maintained in abutment against a portion of the base.

Still further according to the invention, the base further includes an upper wall adapted to project towards the bag, and constitutes the portion of the base for maintaining the rods in the deployed position, and a support wall which is attached to the upper wall and which is adapted to be affixed to an upper rim of the bag.

Still further according to the invention, at each of the ends of the base, a compartment is provided which is opened away from the bag and away from the upper wall of the base, the compartment forming a rotational bearing for a respective one of the two rods and which is defined by an external wall of the base and an internal wall of the base. The external wall and the internal wall are parallel with each other and within the compartment an upper end of a respective one of the two rods is received and is supported in rotation by coaxial swivels integrated with the respective rods, rotationally mounted in the external wall and the internal wall.

According to a still additional aspect of the invention, parallel cut-outs are formed in the external wall and the internal wall, the cut-outs opening to external edges of respective ones of the external wall and the internal wall, each of the rods further including, at respective upper ends of the rods, coaxial swivels projecting from opposite sides of the each of the rods, the swivels being received within the cut-outs thereby constituting the journalling of the two rods about the rotational axes.

According to a still further aspect of the invention, one of the coaxial swivels of each of the two rods, which is received in one of the cut-outs formed in the external wall, ends in an enlarged head positioned to externally of the external wall, and another of the coaxial swivels of each of the two rods, which is received in one of the cut-outs formed in the internal wall, projects beyond the internal wall to be connected, by means of a coupling element, to a linkage bar which extends beneath the upper wall of the base, between the coupling elements for each of the two rods, so as to render integral the rotation the two rods.

Still further, each of the two rods ends, at an upper end, in a cap defined by two parallel lateral side plates and from which, respectively, the two coaxial swivels extend.

According to a still further aspect of the present invention, each of the two rods further includes, in a surface adapted to face the bag, a groove extending from the cap and within which a respective one of the traction springs is partially positioned, the traction spring being attached at an end of the groove at the traction point to a transverse pin.

More specifically according to the invention, a respective one of the traction springs extends along the support wall and into the opening and is attached, at the attachment point, to a pin, which pin extends across the opening.

In a specific embodiment, the external wall of each of the base are parallel to one another.

In another embodiment, the external walls of the base are positioned to converge towards the bag, and wherein the rotational axes of the two rods converge away from the bag.

According to a specific feature of the invention, parallel cut-outs are formed in the external wall and the internal wall, the cut-outs opening to external edges of respective ones of the external wall and the internal wall, each of the rods further including, at respective upper ends of the rods, coaxial swivels projecting from opposite sides of the each of the rods. The swivels are received within the cut-outs thereby constituting the journalling of the two rods about the rotational axes, one of the coaxial swivels of each of the two rods, which is received in one of the cut-outs formed in the external wall, ending in an enlarged head positioned to the externally of the external wall. Another of the coaxial swivels of each of the two rods, which is received in one of the cut-outs formed in the internal wall, projects beyond the internal wall to be connected, by means of a coupling element, to a linkage bar which extends beneath the upper wall of the base, between the coupling elements for each of the two rods, so as to render integral the rotation the two rods, wherein each of the coupling elements constitutes an element of a journal of the cardan type, each of the coupling elements having a cylindrical shape, and having diametrically opposed cut-outs. The cut-outs are, further, variable in width. The linkage bar has opposed ends, each of the ends having spaced tips, the spaced tips of the respective ends of the linkage bar are received within the opposed cut-outs of a respective one of the coupling elements, the variable width of the cut-outs of the coupling elements enabling the required clearance for the tips during rotation of the linkage bar.

BRIEF DESCRIPTION OF DRAWINGS

The invention will now be described by way of a non-limiting example with reference to one embodiment of the present invention shown in the annexed drawings in which.

DETAILED DESCRIPTION OF PREFERRED EMBODIMENTS

Figure 1:
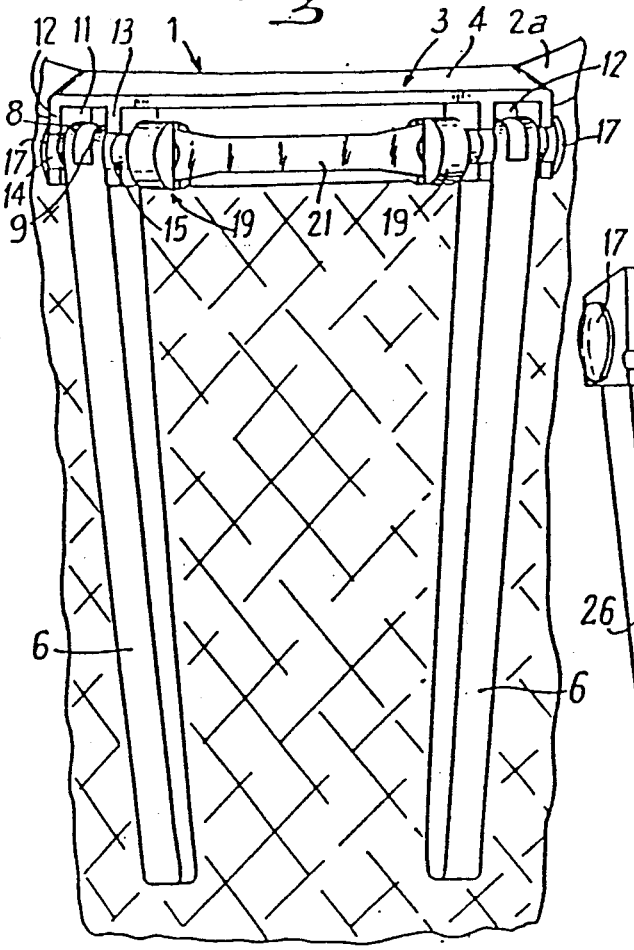
FIG. 1 is an elevation view, from the exterior, of a retractable stand support for a golf bag, in the rest position in which the rods extend the length of the upper portion of the bag.
Figure 2:
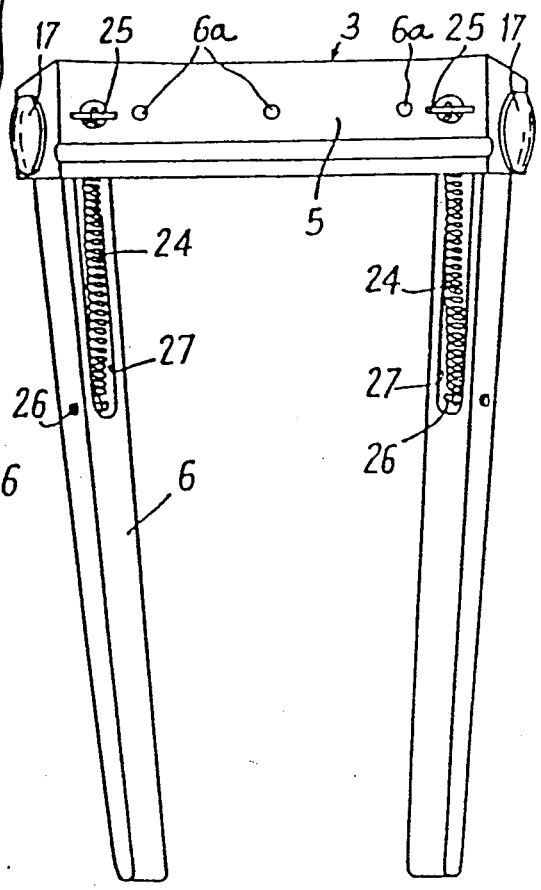
FIG. 2 is an elevation view of the support of FIG. 1, seen from the interior, in the rest position.

The present invention attempts to overcome the above disadvantages by providing a particularly simple and compact structural support ensuring a firm maintenance of the support rods in the deployed position.

To this end, the retractable support rods for a golf bag comprising a base adapted to be affixed to a golf bag is provided, with two journalled rods on the base around axes to be movable between a rest position and a deployed position, and elastic return means for the rods, is characterized in that the elastic return means are constituted by two individual traction springs of which one end is hooked on the base at an attachment point, while the other is on the traction point of the rod, the attachment points and the traction points being positioned with respect to one another in a manner that, during pivoting of the rod from its rest position to its deployed position, or vice versa, the traction point passes from one side of the plane to the other through the rotational axis and the attachment point, the deployed position being defined by an abutment system.

With regard to the drawings, the support having retractable rods according to the invention, which is designated in its entirety by reference 1 in the drawing, is affixed to the exterior of the upper rim 2*a* of golf bag 2, rim which surrounds the upper opening of the bag through which pass through the golf club heads positioned in the bag. Support 1 comprises a base 3 made of a single piece, preferably formed from a molded plastic material, which comprises an upper horizontal wall 4 extending to project towards the exterior and a support wall 5 which is attached to the upper horizontal wall 4 by being perpendicular thereto, or substantially so, or by forming an acute angle therewith. The support wall 5 is formed with holes 62 for the passage of screws adapted for the attachment of base 3 of flexible support 1 on the upper rim 2*a* of bag 2.

Figure 3:
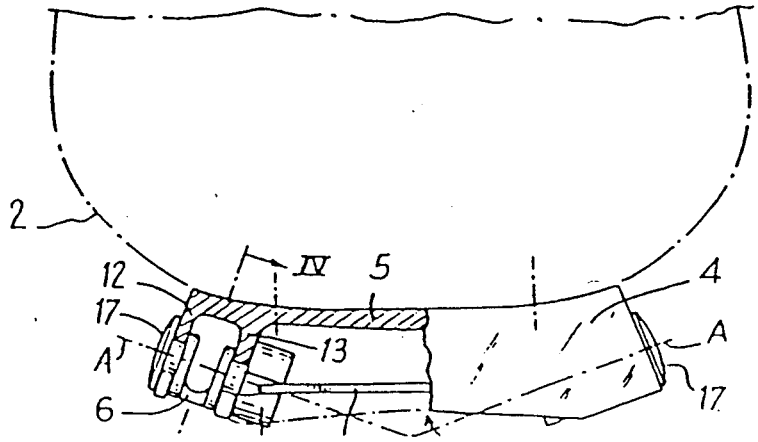
FIG. 3 is a plan view, with partial break-away, of the support in the rest position.
Figure 12:
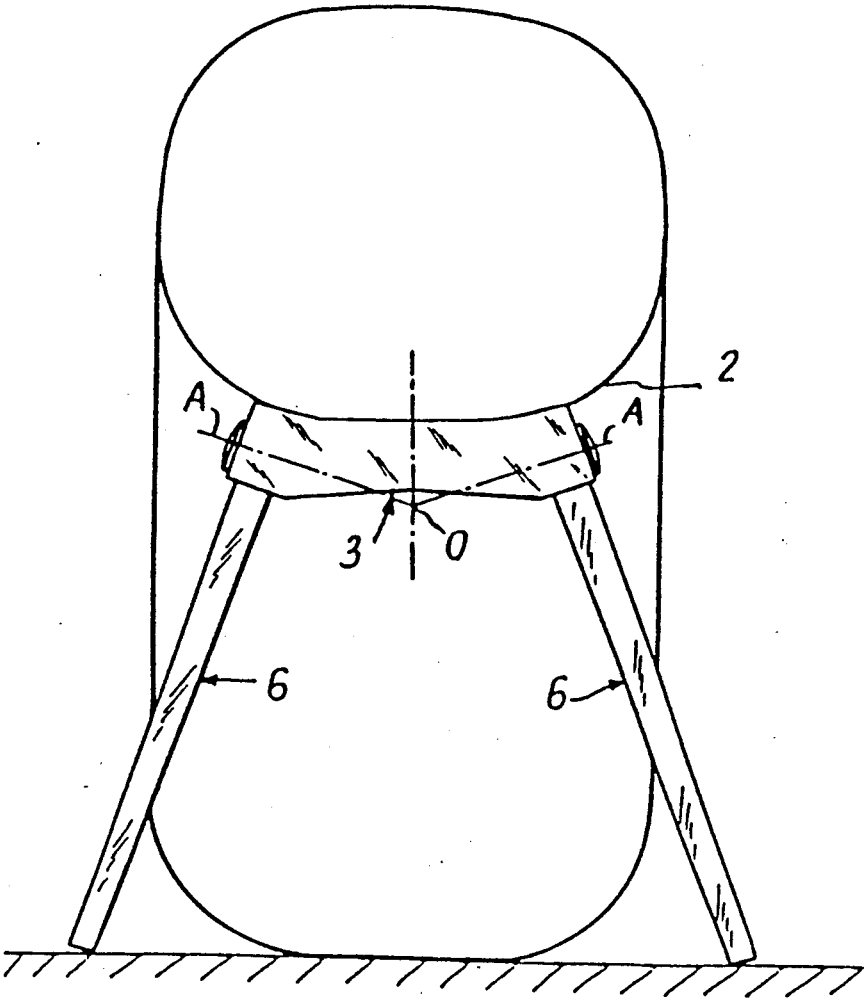
FIG. 12 is an elevation view of the deployed support maintaining the golf bag in the inclined position with respect to the ground.

Support 1 comprises two retractable rods 6 which are adapted to be supported on the ground, at their lower ends, to support a golf bag or other object, and which are journalled, at their upper ends, on base 3. To this end, each rod 6, preferably molded out of plastic material, ends, at its upper end, in a cap 7 defined by two lateral parallel side plates 8 and 9. This cap 7 is tightly nested in compartment 11 forming a rotational bearing for the rod 6 and which is formed at each end of base 3. Each compartment 11 forming a bearing is defined by an external wall 12, constituting the frontal wall of base 3, and by an internal wall 13, these two walls 12 and 13 being parallel to one another and being molded with two walls 4 and 5 of base 3. The two frontal walls 12 of base 3 can be parallel, but preferably converge towards the interior of bag 2, such that the rotational axes A of the two rods 6 converge in turn at point O, as shown in FIGS. 3 and 12, situated on the exterior of base 3. Each compartment 11 is opened towards the exterior and bottom to allow for a free angular movement of rod 6. Walls 12 and 13, each defining compartment 11, are formed with respective parallel cutouts 14 and 15 which open onto the rear vertical edges of the two walls 12 and 13.

Figure 5:
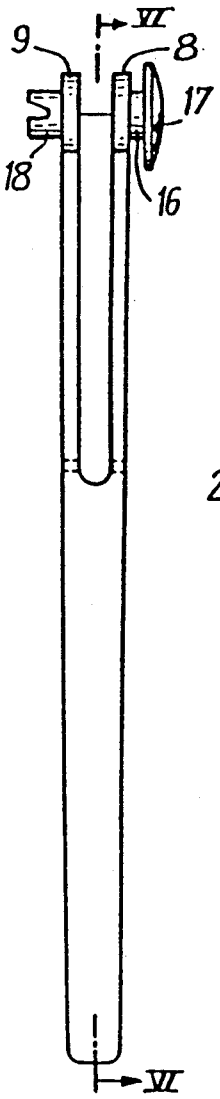
FIG. 5 is an elevation view of the front of a surface of the rod which is turned towards the bag.
Figure 6:
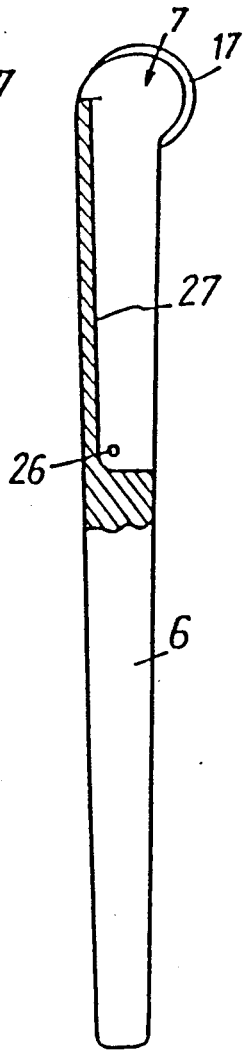
FIG. 6 is a cross-sectional view along VI—VI of FIG. 5.
Figure 7:
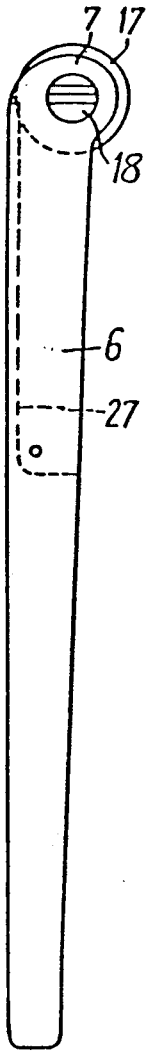
FIG. 7 is a side view of the rod shown in FIG. 5.

As can be better seen in FIG. 5, each rod 6 has at its upper ends, on both sides of lateral side plates 8 and 9 defining cap 7, respectively, a swivel 16 projecting from lateral side plate 8 and ending in an enlarged head 17 and a cylindrical coupling swivel 18, projecting from opposite lateral side plate 9. The two swivels 16 and 18 are coaxial and they are respectively engaged in the aligned cutouts 14 and 15 in a manner so as to form the axis of rotation A of rod 6. Swivel 16 is engaged in cutout 15 of front wall 12, as head 17 is situated to the exterior of this wall, so as to immobilize the rod 6 against any axial movement. The coupling swivel is, itself, engaged in cutout 15 provided in internal wall 13 and it projects beyond this wall to be connected, by means of a coupling element 19 of the cardan type, to a linkage bar 21.

Figure 11:
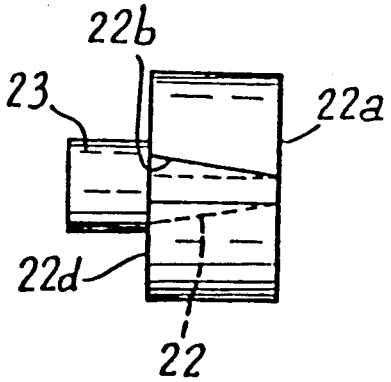
FIG. 11 is a plan view of the coupling element of FIG. 10.

The linkage bar 21 extends, under upper wall 4 of base 3, between the two coupling elements 19 of the cardan type so as to integrate the two rods 6 when they rotate so that they rotate as one. The linkage bar 21 is planar and has at each end 21*a* the general shape of a C, having opposing tips 21*b* and 21*c* which are engaged in the coupling element 19. The coupling element 19 has a cylindrical shape and is tapered, on its frontal surface 22*a* which is turned towards the linkage bar 21, with cutouts 22*b* and 22*c* which are diametrically opposed and within which are respectively engaged the opposing tips 21*b* and 21*c* of the end 21*a* in the form of a C of bar 21. As can be seen in FIG. 11, the two diametrical cutouts 22*b* and 22*c* each have a width which increases starting at the frontal surface 22*a* which makes it possible to obtain the necessary transverse clearance for the tips 21*b* and 21*c* during rotation of the linkage bar 21. The cylindrical coupling element 19 has, on its frontal surface 22*d* which is opposite to that which is engaged the end 21*a* of the linkage bar 21, a sleeve 23 which is coupled with head 18 of rod 6.

Figure 4:
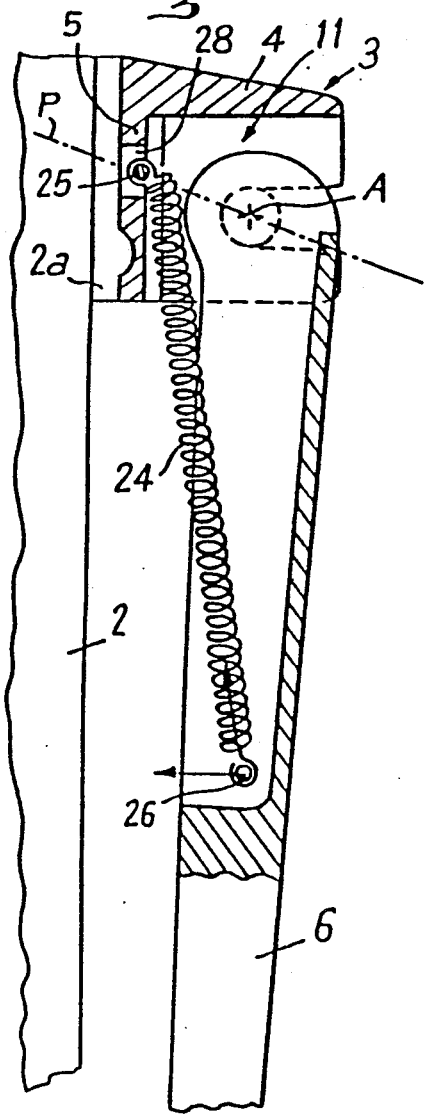
FIG. 4 is a vertical cross-sectional view on a larger scale along line IV—IV of FIG. 3.
Figure 8:
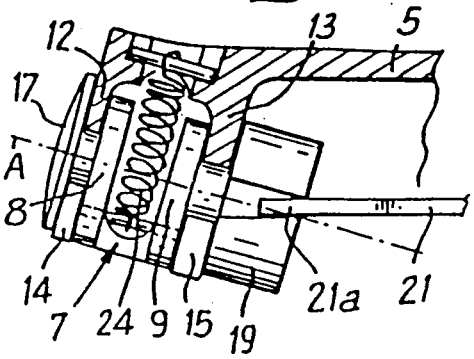
FIG. 8 is a partial horizontal cross-sectional view of an upper journal of a rod.
Figure 9:
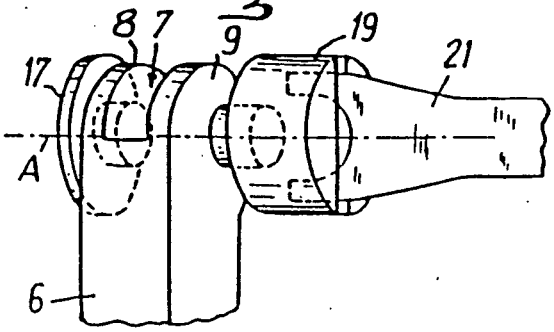
FIG. 9 is a partial perspective view of the journal of FIG. 8.
Figure 10:
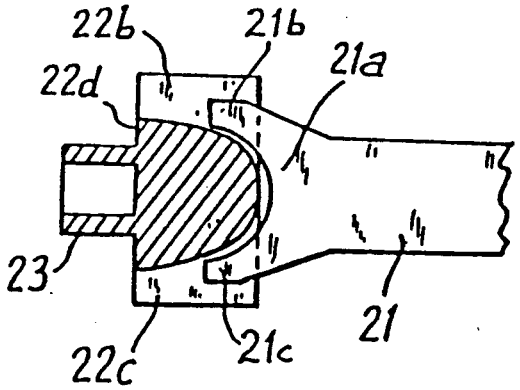
FIG. 10 is an axial cross-sectional view of a coupling element with a journal of the cardan type.

The return of each rod 6 to the rest position, in which it is retracted along bag 2 as is shown in FIG. 4, is ensured by a traction spring 24 which is hooked, at its upper end, at a fixed point of support wall 5 of base 3 at pin 25 and, at its lower end, at a traction point 26 of rod 6. The traction point 26, which is movable with rod 6, is constituted by a pin which extends transversely in the bottom of a groove 27 which is hollowed-out from an upper cap 7, in the surface of rod 6 which is turned towards bag 2. Within compartment 11 the upper portion of return spring 24 extends along the length of the lower portion of the internal surface of wall 5 and it extends across an opening 28 in wall 5 and is fixed with respect to wall 5 at pin 25. Pin 25 is preferably affixed to the wall in a recess shown in FIG. 8 in which the force of the spring 24 pulls the pin 25 and retains the pin in the recess. During assembly, the end of spring 24 is firstly fixed to pin 25 and the pin is then inserted within and then pulled across opening 28 and is placed within the aforementioned recess. In the rest position, as shown in FIG. 4, the movable attachment point 26 of spring 24 is positioned beneath plane P passing through fixed attachment 25 and the axis of rotation A of rod 6 as well as the traction spring 24 biases the rod 6 in the clockwise direction, i.e., in the direction of the bag.

Each of the rods 6 has, in its surface which is turned towards bag 2, a groove 27 which is hollowed-out from the upper cap 7 and within which is positioned partially the traction spring 24 which is hooked to the end of groove 27, at the traction point 26 which can be constituted by a transverse pin.

Figure 13:
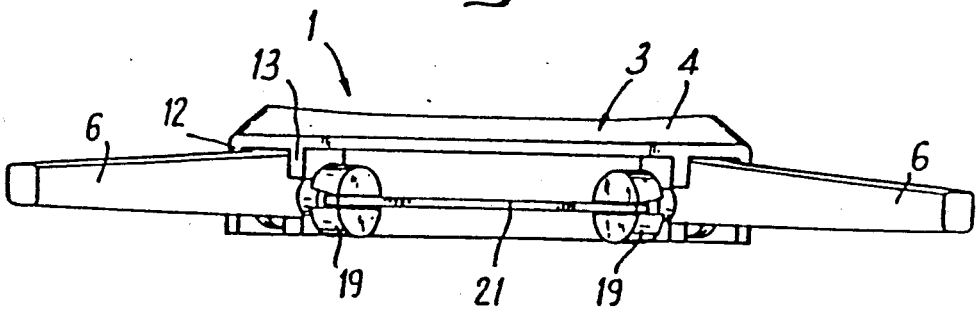
FIG. 13 is an elevation view, from the exterior, analogous to that of FIG. 1, of the support in the deployed state.
Figure 14:
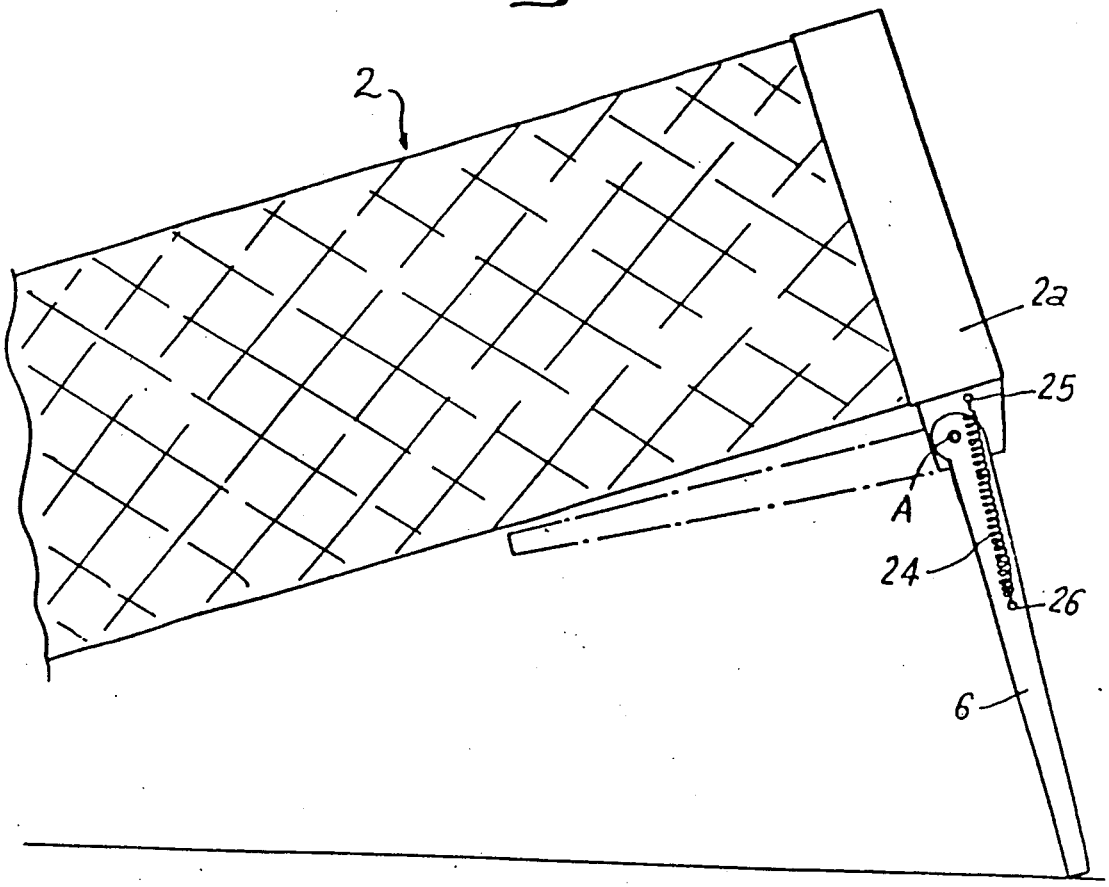
FIG. 14 is a side view, partially in cross-section, of the deployed support maintaining the golf bag in the inclined position.

When one desires to rest the golf bag on the ground in the inclined position, one merely pulls on one or the other of the two rods 6 towards the exterior, so as to bring such rod into a position perpendicular, or substantially perpendicular, to the bag 2. This corresponds to a rotation of about 90° in the counter-clockwise direction from the position shown in FIG. 4 until the position shown in FIGS. 12–14. The rotational movement of the rod 6 which is pulled, is transmitted to the other rod 6 by means of the two coupling elements 19 of the intermediate linkage bar 21. This deployment movement of rods 6 of support 1 occurs at the beginning with an increase in the tension of spring 24, by virtue of its extension, until a resistance point is reached when the traction point 26 is positioned in the plane P defined by the upper attachment point 25 and the journal axis A. As soon as this point is passed, i.e., as soon as the traction point passes above this plane P, the action of spring 24 reverses and the spring then biases the rod 6 in the counter-clockwise direction, which results in it automatically passing to the deployed position. By the aforementioned configuration of the rods 6 and positions of the attachment points of the springs 24, a bi-stable mechanism is provided such that the springs 24 selectively maintain the respective rods 6 in either the rest position, shown in FIG. 1, or in the deployed position, shown in FIG. 12. In the deployed position, each rod 6 is positioned to abut against the upper wall 4 of base 3 where it is perpendicular, or is substantially perpendicular, to the support wall 5. By virtue of the fact that the journal axes A of the two rods 6 converge at the point O positioned to the exterior of base 3, the two rods pass from a rest position in which they are slightly converging at their lower ends, as is shown in FIG. 1, to a deployed position in which they are slightly diverging as is shown in FIG. 12.

As can be seen from the description which has preceded, the support 1 is provide din a very simple manner, essentially with elements made out of a molded plastic material and all of the elements of the journal apparatus and of the linkage are positioned and protected in base 3, the return springs 24 also being positioned and protected in grooves 27 of rods 6. The manipulation to make the support 1 pass from its rest position to its deployed position, or vice versa, is very simple because it is necessary only to activate in one direction or the other one of the rods 6 for the other rod to follow the same movement, with an automatic return of the rods 6 to the rest or deployed position, at the end of the movement, under the effect of springs 24.

The invention is also directed to a bag equipped with a support made of retractable rods according to the invention such as previously described. Thus, the base 3 of the support can be individually molded and adapted to be affixed on the upper rim 2*a* of bag 2 or, according to an alternative, it can be permanently associated with a bag 2. In this latter case, the base 3 can then be molded out of a single piece with the upper rim 2*a* of the bag. The phantom lines identifying the bag 2 in FIG. 3 would be, in that case, alternatively shown as solid lines.

Although the invention has been described with reference to particular means, materials and embodiments, it is to be understood that the invention is not limited to the particular disclosed and extends to all equivalents within the scope of the claims.

What is claimed is:

1. A retractable support stand for a golf bag comprising:

a base adapted to be affixed to a golf bag;

two rods journalled on said base around predetermined rotational axes for movement between a rest position and a deployed position; and means for elastically biasing each of said two rods toward either of said rest position and said deployed position;

wherein said biasing means comprise a traction spring provided for each of said rods, a first end of each said spring being affixed relative to said base at an attachment point, and a second end of each spring being affixed relative to a respective one of said rods at a traction point, said attachment points and said traction points being positioned, with respect to one another, in a manner such that during pivoting of either of said rods from a respective rest position, at which said either of said rods is adapted to be positioned adjacent said bag, to a respective deployed position, at which said either of said rods is adapted to project from said bag, or during pivoting of said either of said rods from said deployed position to said rest position, a respective traction point passes from one side to the other of a plane passing through a respective attachment point and a respective rotational axis of said either of said rods.

2. The retractable support stand of claim 1, further comprising a linkage bar connecting said two rods, said linkage bar being positioned adjacent said plane.

3. The retractable support stand of claim 2, further comprising a cardan type assembly connecting respective ends of said linkage bar and respective ones of said two rods proximate said rotational axes of said two rods.

4. The retractable support stand of claim 1, wherein, in said deployed position, each of said rods is maintained in abutment against a portion of said base.

5. The retractable support stand of claim 4, wherein said base further comprises an upper wall adapted to project towards said bag, and constituting said portion of said base for maintaining said rods in said deployed position, and a support wall which is attached to said upper wall and which is adapted to be affixed to an upper rim of said bag.

6. The retractable support stand of claim 5, said base further comprising a pair of ends and, at each of said ends of said base, a compartment which is opened away from said bag and away from said upper wall of said base, said compartment forming a rotational bearing for a respective one of said two rods and which is defined by an external wall of said base and an internal wall of said base, said external wall and said internal wall being parallel with each other, wherein within said compartment an upper end of a respective one of said two rods is received and is supported in rotation by coaxial swivels integrated with said one of said rods, rotationally mounted in said external wall and said internal wall.

7. The retractable support stand of claim 6, further comprising parallel cut-outs formed in said external wall and said internal wall, said cut-outs opening to external edges of respective ones of said external wall and said internal wall, each of said rods further comprising, at respective upper ends of said rods, coaxial swivels projecting from opposite sides of said each of said rods, said swivels being received within said cut-outs thereby constituting said journalling of said two rods about said rotational axes.

8. The retractable support stand of claim 7, wherein one of said coaxial swivels of each of said two rods, which is received in one of said cut-outs formed in said external wall, ends in an enlarged head positioned to the externally of said external wall, and wherein another of said coaxial swivels of each of said two rods, which is received in one of said cut-outs formed in said internal wall, projects beyond said internal wall to be connected, by means of a coupling element, to a linkage bar which extends beneath said upper wall of said base, between said coupling elements for each of said two rods, so as to render integral the rotation said two rods.

9. The retractable support stand of claim 6, wherein each of said two rods ends, at an upper end, in a cap defined by two parallel lateral side plates and that from which, respectively, said two coaxial swivels extends.

10. The retractable support stand of claim 9, wherein each of said two rods further comprises, in a surface adapted to face said bag, a groove extending from said cap and within which a respective one of said traction springs is partially positioned, said traction spring being attached at an end of said groove at said traction point to a transverse pin.

11. The retractable support stand of claim 10, wherein a respective one of said traction springs extends along said support wall and into said opening and is attached, at said attachment point, to a pin, which pin extends across said opening.

12. The retractable support stand of claim 6, wherein said external wall of each of said base are parallel to one another.

13. The retractable support stand of claim 6, wherein said external walls of said base are positioned to converge towards said bag, and wherein said rotational axes of said two rods converge away from said bag.

14. The retractable support stand of claim 13, further comprising parallel cut-outs formed in said external wall and said internal wall, said cut-outs opening to external edges of respective ones of said external wall and said internal wall, each of said rods further comprising, at respective upper ends of said rods, coaxial swivels projecting from opposite sides of said each of said rods, said swivels being received within said cut-outs thereby constituting said journalling of said two rods about said rotational axes, wherein one of said coaxial swivels of each of said two rods, which is received in one of said cut-outs formed in said external wall, ends in an enlarged head positioned to the externally of said external wall, and wherein another of said coaxial swivels of each of said two rods, which is received in one of said cut-outs formed in said internal wall, projects beyond said internal wall to be connected, by means of a coupling element, to a linkage bar which extends beneath said upper wall of said base, between said coupling elements for each of said two rods, so as to render integral the rotation said two rods, wherein each of said coupling elements constitutes an element of a journal of the cardan type, said each of said coupling elements having a cylindrical shape, and having diametrically opposed cut-outs, which are variable in width, said linkage bar having opposed ends, each of said ends having spaced tips, said spaced tips of said respective ends of said linkage bar being received within said opposed cut-outs of a respective one of said coupling elements, said variable width of said cut-outs of said coupling elements enabling a required clearance for said tips during rotation of said linkage bar.

15. The retractable support stand of claim 1 in combination with said golf bag.

16. The combination of claim 15, wherein said bag comprises an upper rim, and wherein said base is molded out of one piece with upper rim of said bag.

17. The combination of claim 15, wherein said bag comprises an upper rim, and wherein said base of said support is individually molded and is affixed on said upper rim of said golf bag, exteriorly of said upper rim.

18. A support stand for a golf bag comprising:

a base adapted to be affixed to a golf bag, said base having an abutment surface;

at least one support member connected to said base for movement between a rest position and a support position, wherein in said support position, said support member is adapted to extend outwardly from said golf bag to support said golf bag;

means for selectively biasing said support member toward either of said rest position and said support position, wherein in said support position, said biasing means biases a portion of said support member against said abutment surface of said base; and wherein said support member is mounted to said base at a journal axis, wherein said biasing means comprises a spring being connected to said base at a traction point, wherein in said rest position, said traction point is positioned on one side of a plane passing through said journal axis and said attachment point, and in said support position, said traction point is positioned on an opposite side of said plane passing through said journal axis and said attachment point.

19. The support stand of claim 18, wherein said at least one support member comprises two of said support members, wherein said two support members are each connected to a linkage member by means proximate said plane passing through said journal axis and said attachment point.

20. The support stand of claim 19, wherein said two support members are each connected to a linkage member by a coupling element, said coupling elements being of the cardan type.

21. The support stand of claim 19, wherein said two support members are each connected to a linkage member by a coupling element, wherein each of said coupling elements have a generally cylindrical shape and have diametrically opposed cut-outs, which are variable in width, said linkage member having opposed ends, each of said ends having spaced tips, said spaced tips of said respective ends of said linkage member being received within said opposed cut-outs of a respective one of said coupling elements, said variable width of said cut-outs of said coupling elements enabling a required clearance for said tips during rotation of said linkage member.

22. The support stand of claim 19, wherein said linkage member constitutes means for moving one of said support members (1) from said rest position to said support position by movement of the other of said support members from said rest position to said support position and (2) from said support position to said rest position by movement of the other of said support members from said support position to said rest position.

23. The support stand of claim 22, wherein said support members are rods which are adapted to extend divergently from said base with respect to each other in said support position, and are adapted to extend less divergently in said rest position.

24. The support stand of claim 23, wherein said support members are adapted to converge toward each other from said base in said rest position.

25. A support stand for an object comprising:

a base adapted to be affixed to said object;

two support members mounted about respective journal axes with respect to said base for movement between a collapsed position and a deployed position, wherein said two support members extend divergently from said base with respect to each other in said deployed position, and are adapted to extend less divergently in said collapsed position;

said two support members being connected by means of a linkage member, and wherein said linkage member constitutes means for moving one of said support members (1) from said collapsed position to said deployed position by movement of the other of said support members from said collapsed position to said deployed position and (2) from said deployed position to said collapsed position by movement of the other of said support members from said deployed position to said collapsed position; and said two support members being each connected to said linkage member by a coupling element, each said coupling element being of the cardan type.

26. The support stand of claim 25 in combination with said object, wherein said base is unitary with said object.

27. The combination of claim 26, wherein said object is a golf bag.

* * * * *